US007305725B2

(12) United States Patent
Burton

(10) Patent No.: US 7,305,725 B2
(45) Date of Patent: Dec. 11, 2007

(54) APPARATUS FOR MOVING OBJECTS

(75) Inventor: Betty L. Burton, Kalamazoo, MI (US)

(73) Assignee: Relayu Medical Equipment, LLC, Kalamazoo, MI (US)

( * ) Notice: Subject to any disclaimer, the term of this patent is extended or adjusted under 35 U.S.C. 154(b) by 0 days.

(21) Appl. No.: 11/124,988

(22) Filed: May 9, 2005

(65) Prior Publication Data

US 2006/0248644 A1 Nov. 9, 2006

(51) Int. Cl.
*A61G 7/14* (2006.01)

(52) U.S. Cl. ..... 5/81.1 HS; 5/81.1 R

(58) Field of Classification Search ..... 5/81.1 R, 5/81.1 HS, 84.1, 83.1; 602/32–33, 602
See application file for complete search history.

(56) References Cited

U.S. PATENT DOCUMENTS

| | | | | |
|---|---|---|---|---|
| 1,085,879 | A | | 2/1914 | Skeppington |
| 2,827,642 | A | | 3/1958 | Huff |
| 3,597,774 | A | | 8/1971 | Warren |
| 3,829,914 | A | | 8/1974 | Treat |
| 4,744,115 | A | | 5/1988 | Marchione |
| 4,799,273 | A | | 1/1989 | Elze |
| 4,997,054 | A | * | 3/1991 | Denny et al. ..... 180/331 |
| 5,280,657 | A | | 1/1994 | Stagg |
| 5,512,040 | A | * | 4/1996 | Mathews ..... 602/36 |
| 5,608,929 | A | | 3/1997 | Crane |
| 5,901,388 | A | | 5/1999 | Cowan |
| 5,996,144 | A | | 12/1999 | Hodgetts |
| 6,282,734 | B1 | | 9/2001 | Holberg |
| 6,591,435 | B1 | | 7/2003 | Hodgetts |
| 6,615,423 | B2 | | 9/2003 | Sverdlik et al. |
| 6,629,323 | B2 | * | 10/2003 | Sverdlik et al. ..... 5/81.1 C |
| 6,662,388 | B2 | | 12/2003 | Friel et al. |

* cited by examiner

*Primary Examiner*—Patricia Engle
*Assistant Examiner*—Fredrick Conley
(74) *Attorney, Agent, or Firm*—Jonathan P. O'Brien; Catherine Prody; Miller, Canfield, Paddock and Stone, P.L.C.

(57) ABSTRACT

A lifting apparatus with a substantially horizontal crossbeam having a first end pivotally connected to a first side of a bed frame and a second end pivotally connected to a second side of the bed frame. A rod has a free first end and a second end fixedly connected to the cross beam. A clamp secures the crossbeam from pivoting. Tension members are securedly attached on one end to a flat bar and on the other end to a point disposed between the first and second ends of the rod.

31 Claims, 2 Drawing Sheets

APPARATUS FOR MOVING OBJECTS

BACKGROUND OF THE PRESENT INVENTION

The present invention relates to an apparatus for moving objects. More particularly, it relates to an apparatus adapted to move people in hospital beds.

Patients confined to hospital beds over an extended period of time can result in unique and sometimes problematic challenges for the patient, his or her family, and caregivers. Over time, the effects of gravity will force a bedridden patient towards the foot of a bed. Patients that are supine, incapacitated, or obese oftentimes lack the necessary strength or ability to pull themselves back up to the head of the bed. Frequently, the patient is adjusted by two or more attendants who grasp the patient under the arms or by the back and pull the patient back to the head of the bed. This method of adjustment can result in injury to both the patient and the attendants adjusting the patient. Back injuries to hospital attendants are frequent with this method of adjustment. Further, patients who require assistance to move to the head of the bed are usually patients that are weak or in a fragile condition due to injury, illness, or unconsciousness.

Apparatus have been developed to attempt to resolve these problems. However, such apparatus are very large and bulky or very costly, or both. Accordingly, an apparatus for moving people in hospital beds and which lessens the likelihood of injury to the patient and attendant, and which is also cost-effective is desired.

SUMMARY OF THE INVENTION

One aspect of the present invention is a lifting apparatus with a substantially horizontal crossbeam having a first end pivotally connected to a first side of a bed frame and a second end pivotally connected to a second side of the bed frame. A rod has a free first end and a second end fixedly connected to the cross beam. A clamp secures the crossbeam from pivoting. Tension members are securedly attached on one end to a flat bar and on the other end to a point disposed between the first and second ends of the rod.

In another aspect of the present invention, an apparatus for relocating a patient has an inverted, T-shaped, member having a bottom end attached to a frame of a bed, a midsection having a catch attached to first and second connecting components, and a top end having a handle. A fastener is provided that is adapted to connect the bottom end of the inverted, T-shaped member to a bed frame, and adapted to limit rotation of the T-shaped member. The apparatus also has a substantially planar sheet connecting member having a first end secured to the first connecting component and a second end secured to the second connecting component.

In yet another aspect of the present invention, a method for adjusting the position of a patient in a bed is provided, wherein the method includes providing a moment arm connected on a first end to a cross member and having a handle disposed on a second end. A first end of each of two tension lines is attached to the moment arm, and a second end of each of the two tension lines is attached to a bar. The bar is fixedly attached to a sheet by rotating the sheet about the bar, and pressure is applied to the handle of the moment arm, thereby shifting the location of the rod and the sheet.

The present invention provides a simple and efficient solution to adjusting a patient in a hospital bed. The probability of injury to both the patient and hospital attendants is lessened compared to manually repositioning a patient.

These and other features, advantages and objects of the present invention will be further understood and appreciated by those skilled in the art upon studying the following specification, claims, and appended drawings.

DETAILED DESCRIPTION OF PREFERRED EMBODIMENTS

Figure 2:
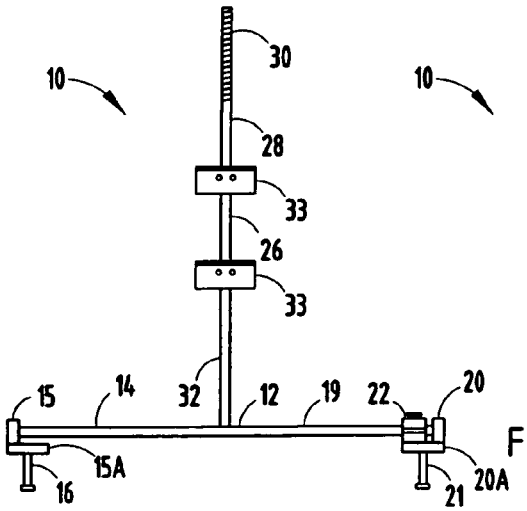
FIG. 2 is a front elevational view of the apparatus of the present invention.

For purposes of description herein the terms "upper", "lower", "right", "left", "rear", "front", "vertical", "horizontal" and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
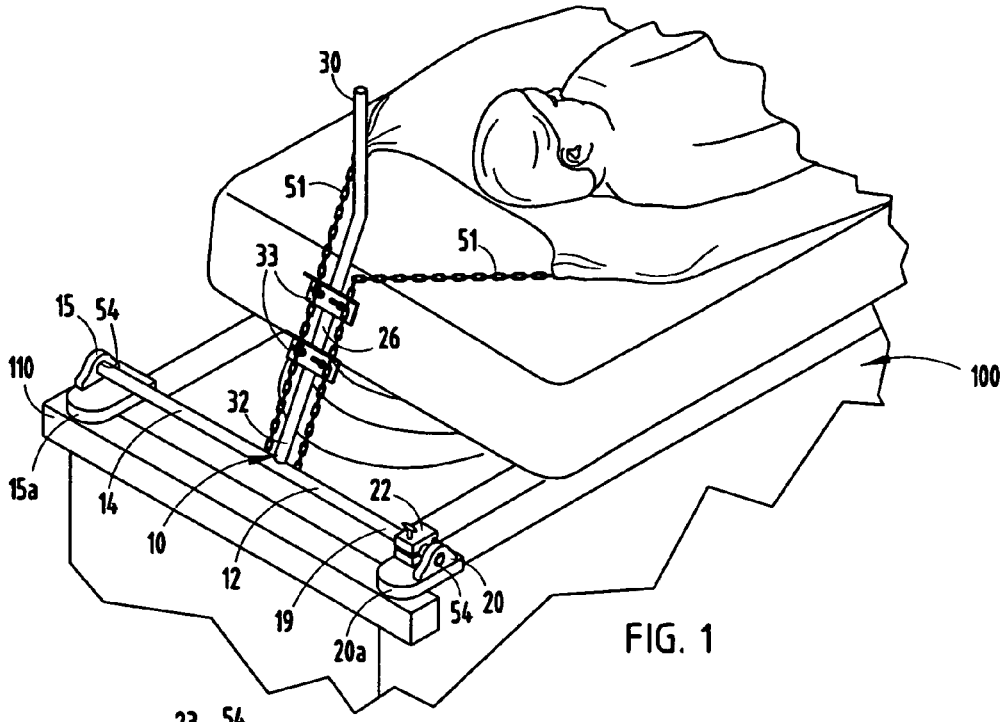
FIG. 1 is a partial perspective view of the present invention connected to a hospital bed.
Figure 1A:
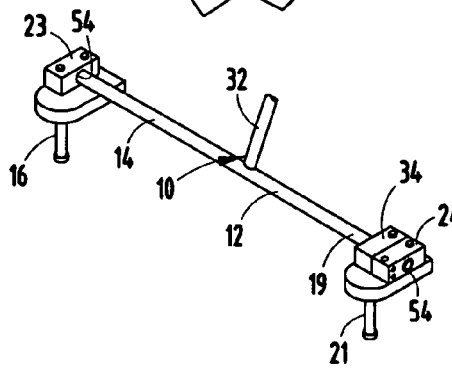
FIG. 1*a* is a partial perspective view of an alternative embodiment of the present invention.
Figure 2A:
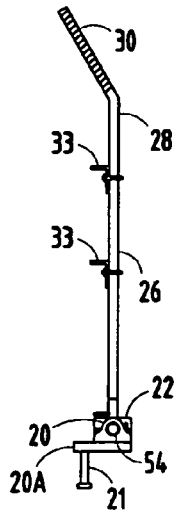
FIG. 2*a* is a side elevational view of the apparatus of FIG. 2.

As illustrated in FIGS. 1, 2, and 2A, the reference numeral 10 generally designates an apparatus for moving people in hospital beds. Apparatus 10 is generally constructed of stainless steel and can be attached to a standard hospital bed 100 at a frame 110 near the head of the bed. Apparatus 10 has a horizontal crossbeam 12 which includes a first end 14 that is pivotally connected to a first bearing mount 15 fixedly attached to a support 15*a*. A mounting peg 16 is securedly connected to a bottom side of support 15*a*. The mounting peg 16 is adapted to detachably connect the apparatus 10 to the bed frame 110. A second end 19 of the horizontal crossbeam 12 is pivotally connected to a second bearing mount 20 fixedly attached to a top portion of a support 20*a*. A mounting clamp 22 is also fixedly attached on a top portion of support 20*a* and is adapted to secure horizontal cross-beam 12 from rotation. On a bottom side of the support 20*a* is a second mounting peg 21 for mounting the apparatus 10 to the bed frame 110. A rod 26 is fixedly attached to and extends upwardly from the horizontal crossbeam 12 to form an inverted "T" shape. The rod 26 has a first free end 28 with a handle 30 and a second end 32 fixedly connected to the crossbeam 12. The handle 30 is angled away from the longitudinal extent of the rod 26 to ergonomically aid an operator during use of the apparatus 10. Chain catches 33 are attached to rod 26 between the handle 30 and the second end 32. Optionally, as shown in FIG. 1A, bearing mounts 15, 20, can be replaced by bushings 23, 24 and are pivotally connected to horizontal cross beam 12. Additionally, as an alternative to the mounting claim 22, FIG. 1A shows an alternative braking device 34 that secures the horizontal cross beam 12 using a threaded member (such as a bolt). The threaded member can be turned through complimentary threads in the braking device and into secure contact with the horizontal cross beam 12 thereby fixing rotation of the horizontal cross beam 12. Alternatively, a spring-loaded tension brake could also be utilized.

Figure 3:
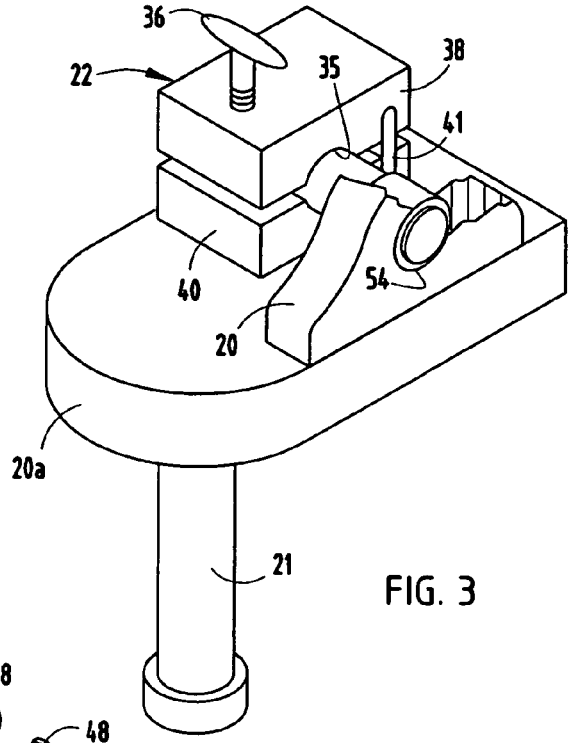
FIG. 3 is a perspective view of a mounting clamp of the present invention.

As shown in FIG. 3, the second bearing mount 20 (shown in partial view) is fixedly attached on top of support 20*a* and is adjacent to mounting clamp 22. Mounting peg 21 is disposed on the bottom side of support 20*a*. Mounting clamp 22 is fixedly attached to a top side of support 20*a* and has a top section 38 and bottom section 40 that together define an aperture 35 which can receive the horizontal crossbeam 12. On the top section 38 of the mounting clamp 22 is a clamp fastener 36, such as a thumb screw or wing nut bolt. The clamp fastener 36 can be tightened thereby forcing each of two sections 38, 40 of the second bearing mount 20 together. Both top section 38 and bottom section 40 of the mounting clamp 22 are attached to a biasing member 41. Biasing member 41 permits mounting clamp 22 to be loosened by biasing the two sections 38, 40 away from one another. When securing the mounting clamp 22 to the horizontal crossbeam 12, clamp fastener 36 is tightened, forcing sections 38, 40 together, and causing biasing member 41 to flex. Forcing sections 38, 40 together frictionally secures mounting clamp 22 to the horizontal crossbeam 12 thereby preventing rotation of the mounting clamp 22. When the clamp fastener 36 is loosened, the compressive force between the top section 38 and bottom section 40 of the mounting clamp 22 is lessened thereby allowing rotation of the horizontal crossbeam 12.

Figure 4:
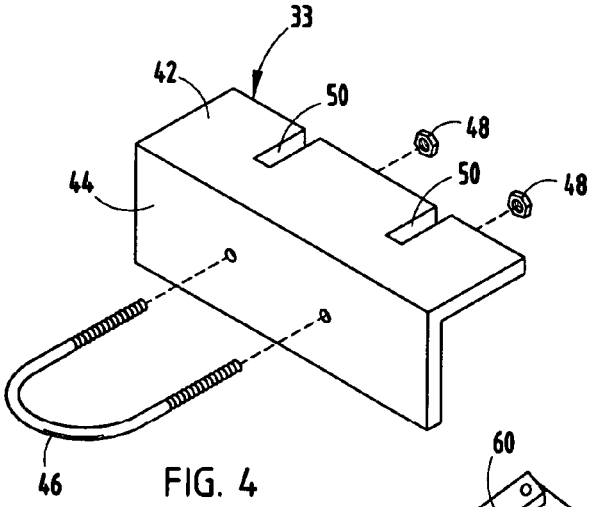
FIG. 4 is a perspective view of a chain catch of the present invention.

FIG. 4 illustrates a chain catch 33 which is configured to be disposed on the rod 26 between the handle 30 and its second end 32. Multiple chain catches may be disposed on the rod 26 to provide added leverage when the apparatus is in use. The body of the chain catch 33 has a first planar portion 42 fixedly connected to a second planar portion 44 to form a bracket or angle iron. The chain catch 33 can be removably anchored to the rod 26 by a securing device 46, such as a U-bolt, and two mechanical fasteners 48, such as hex nuts. On a top portion of the chain catch 33 are two slots 50 adapted to secure a chain 51.

The first bearing mount 15, as previously shown in FIGS. 1 and 2, has a mounting peg 18. The first and second bearing mounts 15, 20 have an aperture 54 through their centers for receiving the horizontal crossbeam 12. Furthermore, the aperture 54 is adapted to allow free rotation of the crossbeam 12. Alternatively, a mounting clamp 22 such as the one shown in FIG. 3 adjacent to the second bearing mount 20 may be disposed on each end of the horizontal crossbeam 12. In this instance, first bearing mount 15 would also be adjacent to mounting clamp 22. This alternative design allows for locking of the horizontal crossbeam 12 on either or both sides of the crossbeam 12.

Figure 5:
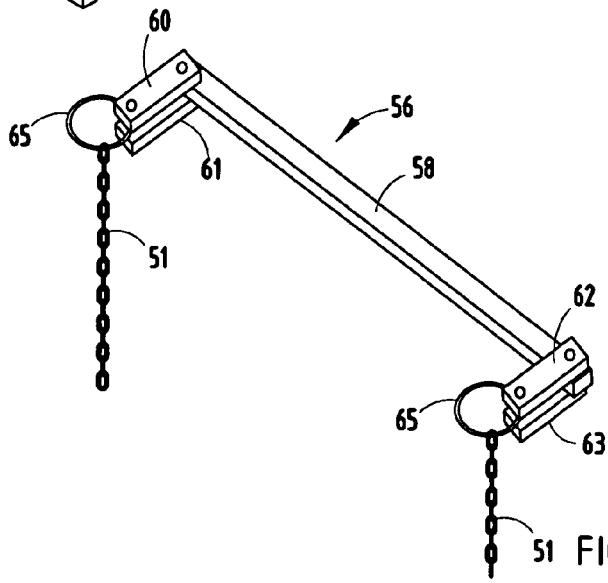
FIG. 5 is a perspective view of a sheet secure of the present invention.

FIG. 5 illustrates a sheet secure 56. The sheet secure 56 has a long flat bar 58, with two shorter bars 60, 61 disposed on a first end of the long flat bar 58 and two short bars 62, 63 disposed on a second end of the long flat bar 58. The short flat bars 60, 61, 62, 63 sandwich the long flat bar 58 and are pivotally connected to each end of the long flat bar 58. In addition, a ring 65 is disposed at each end of the sheet secure 56 for connecting the short flat bars 60, 61, 62, 63 to chain lengths 51. Each chain length 51 then secures to the chain catch 33 disposed on the rod 26. The chain lengths 51 may be replaced with other forms of tension members, including cables or ropes.

In operation, the apparatus of the invention is attached to a hospital bed by securing the mounting pegs 16, 21 to a bed frame. Chain catch 33 is securedly connected to rod 26 by tightening securing device 46 around rod 26 by use of mechanical fasteners 48. Ideally, the chain catch 33 is adjusted so as not to interfere with any other object such as the bed frame or the top of a bed mattress. If the selected chain catch 33 does cause the chain to interfere with the bed frame or the top of the bed mattress, then a different chain catch may be utilized. A top portion of a sheet (see FIG. 1) is then wrapped around sheet secure 56, preferably several times, and chain lengths 51 are secured to the chain catch 33. Chain catch 33 is adjusted, if necessary, to a desired height between the handle 30 and the horizontal cross beam 12. Chain lengths 51 are then inserted into slots 50 of the chain catch 33. Clamp fastener 36 is loosened so that horizontal crossbeam 12 is freely rotatable inside apertures 35, 54. The user applies force to the handle 30 in a direction away from the head of the bed, thereby rotating the horizontal crossbeam 12 inside apertures 35, 54 and, consequently, transmitting tensile force to the chain lengths 51 and to the sheet secure 56. This rotation causes the chain 51 and flat bar 58 to be pulled across the top of the bed. Thus, a patient is pulled up towards the head of the bed as the handle 30 is rotated. When the user has successfully repositioned a patient located on the sheet, the user secures clamp fastener 36 thereby locking the apparatus 10 and fixing the position of the patient. The sheet is then unwrapped from the flat bar 58 and thus, sheet secure 56. Optionally, chain 51 may be disengaged from slots 50 thereby allowing the chain to be stored or the chain 51 may be re-engaged with a different chain catch 33.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A lifting apparatus comprising:

a substantially horizontal crossbeam having a first end adapted to pivotally connect to a first side of a bed frame and a second end adapted to pivotally connect to a second side of the bed frame;

a rod having a free first end and a second end fixedly connected to the crossbeam;

a clamp adapted to allow securement of the crossbeam from pivoting;

a sheet secure comprising:

a longitudinal bar;

a first short bar having a first end and a second end, wherein the first end is disposed on a first end of the longitudinal bar; and a second short bar having a first end and a second end, wherein the first end is disposed on a second end of the longitudinal bar; and tension members securedly attached on one end to the rod and on another end to the sheet secure.

2. The lifting apparatus of claim 1, wherein:

the clamp is adapted to be frictionally secured to the crossbeam.

3. The lifting apparatus of claim 2, wherein:
the tension members are removably attached to a chain catch disposed between the first and second ends of the rod.

4. The lifting apparatus of claim 3 further comprising a second clamp adapted to be frictionally secured to the cross beam.

5. The lifting apparatus of claim 4, wherein:
the chain catch is attached to the rod by a U-shaped mechanical fastener.

6. The lifting apparatus of claim 5, wherein:
the apparatus is constructed substantially of stainless steel.

7. The lifting apparatus of claim 3, wherein the chain catch is attached to the rod, by a securing device, wherein the securing device can be moved to any position along the rod between the first end and the second end of the rod.

8. The lifting apparatus of claim 7 further comprising one or more additional chain catches each disposed between the first and second ends of the rod.

9. The lifting apparatus of claim 1 further comprising:
a second clamp adapted to be frictionally secured to the cross beam.

10. The lifting apparatus of claim 1, wherein:
the tension members are chain lengths.

11. The lifting apparatus of claim 1, wherein the first end of the first short bar of the sheet secure is pivotally connected to one end of the longitudinal bar of the sheet secure and the first end of the second short bar of the sheet secure is pivotally connected to the other end of the longitudinal bar of the sheet secure.

12. The lifting apparatus of claim 1, wherein the tension members are attached to the second ends of the short bars of the sheet secure.

13. An apparatus for relocating a patient comprising:
an inverted T-shaped member having:
a bottom end attached to a frame of a bed;
a midsection having a catch attached to first ends of first and second connecting components; and
a top end having a handle;
a fastener connected to the bottom end of the inverted T-shaped member and adapted to limit rotation of the inverted T-shaped member; and
a substantially planar sheet-connecting member comprising:
a longitudinal bar;
a first short bar having a first end and a second end, wherein the first end is disposed on a first end of the longitudinal bar and the second end is secured to the second end of the first connecting component; and
a second short bar having a first end and a second end, wherein the first end is disposed on a second end of the longitudinal bar and the second end is secured to the second end of the second connecting component.

14. The apparatus for relocating a patient of claim 13 wherein:
the fastener comprises a clamp with a manually rotatable nut.

15. The apparatus for relocating a patient of claim 13 wherein:
the apparatus is constructed substantially of stainless steel.

16. The apparatus for relocating a patient of claim 15 wherein:
the sheet-connecting member is substantially the width of a standard hospital bed sheet.

17. The apparatus for relocating a patient of claim 16 wherein:
the catch is adapted to removably secure the first and second connecting components to the inverted T-shaped member.

18. The apparatus for relocating a patient of claim 17 wherein:
the first and second connecting components are chain lengths.

19. The apparatus of claim 13, wherein the catch is attached to the midsection by a securing device, wherein the securing device can be moved to any position along the midsection between the first end and the second end of the midsection.

20. The lifting apparatus of claim 13, further comprising one or more additional catches each disposed on the midsection.

21. The lifting apparatus of claim 13, wherein the first ends of the first and second short bars are pivotally connected to the ends of the longitudinal bar of the sheet connecting member.

22. A method for repositioning a patient in a hospital bed, the method comprising the steps of:
providing a moment arm connected on its first end to a cross member and having a handle on its second end;
providing a sheet secure comprising:
a longitudinal bar;
a first short bar having a first end and a second end, wherein the first end is disposed on a first end of the longitudinal bar; and
a second short bar having a first end and a second end, wherein the first end is disposed on a second end of the longitudinal bar;
attaching a first end of each of two tension lines to the moment arm;
attaching a second end of each of the two tension lines to the second ends of the short bars of the sheet secure;
attaching the sheet secure to a sheet on the bed; and
applying pressure to the handle of the moment arm, thereby shifting the location of the moment arm and pulling the sheet across the bed.

23. The method of claim 22 further comprising the step of:
providing a clamp and connecting the clamp to a cross member, the cross member and clamp adapted to connect the moment arm to a hospital bed.

24. The method of claim 23 further comprising the step of:
tightening the clamp to the cross member, preventing the cross member from rotation.

25. The method of claim 24, wherein:
the two tension lines are attached to the moment arm by a catch.

26. The method of claim 25, wherein:
the catch is removably attached to the moment arm by a securing device, wherein the securing device can be moved to any position along the rod between the first end and the second end of the moment arm.

27. The method of claim 26 further comprising the step of:
moving the securing device to a position along the rod between the first end and the second end of the moment arm.

28. The method of claim 22, wherein the first and second short bars of the sheet secure are pivotally connected to the longitudinal bar of the sheet secure.

29. The method of claim 22, wherein the sheet is attached to the sheet secure by wrapping an end of the sheet around the longitudinal bar of the sheet secure.

30. A lifting apparatus comprising:

a substantially horizontal crossbeam having a first end adapted to pivotally connect to a first side of a bed frame and a second end adapted to pivotally connect to a second side of the bed frame;

a rod having a free first end and a second end fixedly connected to the crossbeam;

a clamp adapted to allow securement of the crossbeam from pivoting;

a catch disposed between the first and second ends of the rods;

a securing device which attaches the catch to the rod, wherein the securing device can be moved to any position along the rod between the first end and second end of the rod;

a sheet secure comprising:

a longitudinal bar;

a first short bar having a first end and a second end, wherein the first end is pivotally connected to a first end of the longitudinal bar; and a second short bar having a first end and a second end, wherein the first end is pivotally connected to a second end of the longitudinal bar; and tension members securedly attached on one end to the catch and on the other end to the second ends of the short bars of the sheet secure.

31. A method for repositioning a patient in a hospital bed, the method comprising the steps of:

providing a moment arm connected on its first end to a cross member and having a handle on its second end;

providing a clamp and connecting the clamp to the cross member;

providing a catch attached to the moment arm by a securing device, wherein the securing device can be moved to any position along the moment arm between the first end and the second end of the moment arm;

providing a sheet secure comprising:

a longitudinal bar;

a first short bar having a first end and a second end, wherein the first end is disposed on a first end of the longitudinal bar; and a second short bar having a first end and a second end, wherein the first end is disposed on a second end of the longitudinal bar;

adjusting the position of the catch on the moment arm;

attaching a first end of each of two tension lines to the catch on moment arm;

attaching a second end of each of the two tension lines to the second ends of the short bars of the sheet secure;

attaching the longitudinal bar of the sheet secure to a sheet on the bed;

applying pressure to the handle of the moment arm, thereby shifting the location of the moment arm and pulling the sheet across the bed; and tightening the clamp to the cross member, preventing the cross member from rotation.

* * * * *